United States Patent [19]

Simon

[11] 4,149,068

[45] Apr. 10, 1979

[54] CIRCULAR SLIDERULE IMPROVEMENT

[76] Inventor: Morris Simon, 8 Otis Pl., Boston, Mass. 02108

[21] Appl. No.: 851,166

[22] Filed: Nov. 14, 1977

[51] Int. Cl.[2] ..... G06C 27/00; G06G 1/02

[52] U.S. Cl. ..... 235/78 R; 235/84; 235/88 R

[58] Field of Search ..... 235/78, 88, 83, 84

[56] References Cited

U.S. PATENT DOCUMENTS

| | | | |
|---|---|---|---|
| 518,438 | 4/1894 | Albert | 235/88 F |
| 591,332 | 10/1897 | Duncan | 235/88 F |
| 974,354 | 11/1910 | Brown | 235/84 |
| 1,243,224 | 10/1917 | Rodolf | 235/78 A |
| 2,289,110 | 7/1942 | Ernst et al. | 235/84 |
| 2,478,096 | 8/1949 | Gilson | 235/84 |
| 2,555,293 | 5/1951 | Raymond et al. | 235/84 |
| 2,585,618 | 2/1952 | Batori | 235/84 |

*Primary Examiner*—Stephen J. Tomsky
*Attorney, Agent, or Firm*—Norvell E. Von Behren

[57] ABSTRACT

An improved circular sliderule for use in many applications wherein it is desired to provide a sliderule having superimposed disc elements which may be freely rotated without disturbing the previous setting of the adjacent discs. The novel improved calculator comprises providing a separating spacer element to be positioned between each disc of the calculator and with each spacer element having formed thereon means for retaining the rotation of the spacer element whenever superimposed discs are rotated. The retaining means may comprise a series of protruding arms, one extending outward from each of the separating spacer elements, joined at their outer ends and locked to the base plate of the calculator which is not rotatable. Alternately the retaining means may comprise the spacer element having formed on an internal hole at least one protuberance which is designed for mating engagement with an engaging means in the form of an elongated slot formed in the central hub which is locked to the baseplate.

7 Claims, 8 Drawing Figures

CIRCULAR SLIDERULE IMPROVEMENT

BACKGROUND OF THE INVENTION

This invention relates generally to rotary disc calculators and more particularly to an improved rotary disc calculator that may be utilized in many areas including but not limited to the medical field and in particular to an x-ray calculator for use in the medical field.

Rotary disc calculators have been manufactured for many years and generally comprise a plurality of circular discs which are positioned on a central hub and utilize one or more cursor arms which are used by the user of the device in various manipulations and calculations for which the calculator was designed. It is also known to provide various types of spacers or washers between the superimposed disc elements of the calculator primarily for the purpose of separating the adjacent discs a given amount so that each disc is able to be rotated by the user of the device.

Examples of such prior art circular sliderule rotary disc calculators are shown in the following patents issued by the U.S. Patent Office:

| Pat. No. | Inventor | Issue Date |
|---|---|---|
| 3,648,025 | R. P. Adams | March 7, 1972 |
| 3,358,920 | M. P. Ringley | December 19, 1967 |
| 3,471,084 | J. B. Titus | October 7, 1969 |
| 3,220,644 | N. Gaudio | November 30, 1965 |

It can be seen from the above cited patents that whenever it is desired by the user of the calculator to rotate one disc without causing adjacent discs to move, the user must hold the disc to to remain stationary while moving the adjacent disc as is the usual practice in calculator manipulation. The reason for this is that there is nothing to prevent one disc from moving the adjacent disc as a result of frictional engagement between the discs. The problem is especially magnified whenever the central hub is tightened with its tightening screw to a degree which will increase the frictional contact between the various adjacent discs.

Such a hand manipulation and holding of the adjacent discs in order to prevent rotation can become especially burdensome whenever the calculator comprises more than two or three rotary discs and is especially burdensome whenever the calculator may comprise for example five or more rotary discs as is common in highly technical calculators such as those used in the medical field and other fields.

SUMMARY OF THE INVENTION

In order to alleviate the problems encountered with the prior art type of calculators as before described, there is provided by the subject invention a new and improved rotary disc calculator wherein the individual discs may be freely rotated by the user of the device without interfering with the previous setting positioned on adjacent discs without having to hold the adjacent disc as practiced in prior art devices. The subject new and improved calculator comprises the use of a separating spacer element being positioned between each pair of discs of the calculator and having formed thereon means for retaining the rotation of the spacer element whenever superimposed discs are rotated. The retaining means may comprise each spacer element having formed on it an outer projecting arm or protuberance which is joined to the corresponding outer arms of all the other spacer elements and is locked to the baseplate of the device with a screw tightening clamp.

Alternately the retaining means may comprise the spacer element being formed with an internal hole having at least one protuberance formed thereon which is designed for mating engagement with an engaging means formed on the central hub. The engaging means may comprise an elongated slot formed in the central hub and may comprise, along with the retaining means, other forms within the spirit and scope of the invention.

Accordingly an object and advantage of the invention is to provide an improved rotary disc calculator having adjacent discs which may be rotated independently from the next adjacent disc without disturbing the previous setting positioned on the adjacent disc.

Another object and advantage of the invention is to provide an improved rotary disc calculator which makes possible the use of large numbers of multiples of discs which may be freely set to a desired setting without danger of that setting being changed as a result of frictional contact between the various discs.

Yet another object and advantage of the invention is to provide an improved locking structure for use with a rotary disc calculator of the type wherein it is felt necessary to be able to set a given position on one disc without disturbing a previous set position on an adjacent disc.

These and other objects and advantages of the invention will become apparent from reviewing the drawing attached hereto and from a reading of the following description of the preferred embodiment.

BRIEF DESCRIPTION OF THE DRAWINGS

FIG. 1 is a front view of a typical rotary disc calculator having a plurality of discs mounted thereon;

FIG. 2 is a back view of the calculator shown in FIG. 1;

FIG. 3 is an end view, taken along line 3—3 of FIG. 1, showing the plurality of discs positioned one on top of each other on a central hub;

FIG. 4 is an exploded perspective view of the calculator shown in FIGS. 1-3 showing the new and novel separating spacer element positioned between selected adjacent discs;

FIG. 5 is an enlarged sectional view, taken along line 5—5 of FIG. 3, showing in greater detail the positioning of the adjacent discs on the central hub and the positioning of the separating spacer element between the adjacent discs with the spacer element having formed thereon the retaining means and the central hub having formed thereon the engaging means hereinbefore described;

FIG. 6 is a front view of the improved rotary disc calculator having a plurality of circular discs mounted on a central hub with the calculator being designed for wall or desk mounting;

FIG. 7 is an enlarged sectional view, taken along line 7—7 of FIG. 6, showing in detail the positioning of adjacent discs on the central hub;and FIG. 8 is an exploded perspective view of the calculator shown in FIGS. 6-7 showing the placement of the separating spacer elements positioned between adjacent discs.

DESCRIPTION OF THE ALTERNATE AND THE PREFERRED EMBODIMENT

Figure 1:
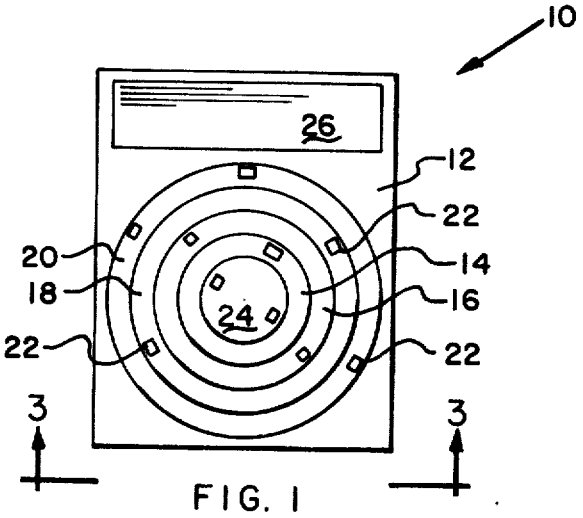
FIGS. 1-5 detail the alternate and earlier embodiment of the subject invention with the following figures illustrating the invention in various views.

Referring to the drawings in general and in particular to FIG. 1 of the drawing there will be shown the alternate and earlier embodiment of the improved rotary disc calculator shown generally by the numeral 10 which comprises a generally rectangular baseplate 12 upon which are positioned a plurality of rotary disc elements 14,16,18 and 20. The rotary disc elements may have a plurality of viewing windows 22 located around the periphery thereof for viewing the material contained behind the window as is well known in the art.

The plurality of rotary disc elements 14–20 are positioned on the rectangular base 12 and are held in place by a central hub 24. The rectangular base may also contain printed indicia 26 giving instructional material and may also contain viewing windows.

Figure 2:
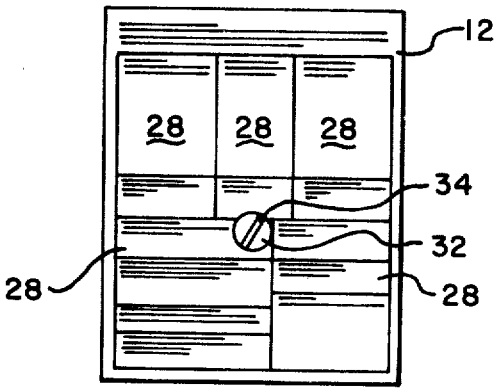

Referring now to FIG. 2 of the drawing there is shown the rear view of the subject calculator which may also contain a series of printed indicia 28 giving further instructions on use of the calculator or may contain advertising material as is common in many calculators today. The rear of the calculator also contains holding means in the form of a bolt 30 having a head 32 containing an elongated slot 34 for using a screwdriver or the like to turn the bolt 30 to tighten the plurality of rotating disc elements on the central hub 24 as will be described more fully hereinafter.

Figure 3:
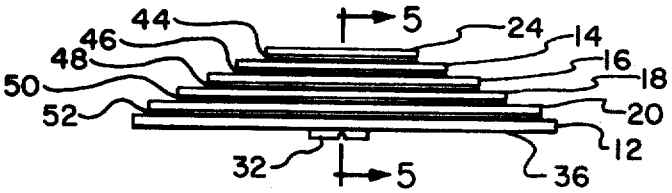

Referring now to FIG. 3 of the drawing, there is shown an end view taken along line 3—3 of FIG. 1 showing the respective placements of the plurality of rotating disc elements 14–20 on top of the rectangular base 12 with the holding means in the form of a bolt 30 with its elongated head 32 bearing against the surface 36 of the rectangular base 12. It can be seen in FIG. 3 of the drawing that in the embodiment shown the plurality of rotary disc elements 14–20 are positioned against each other and each succeeding rotary reference disc element is formed somewhat smaller than the last disc element positioned on the rectangular base from the base up.

Figure 4:
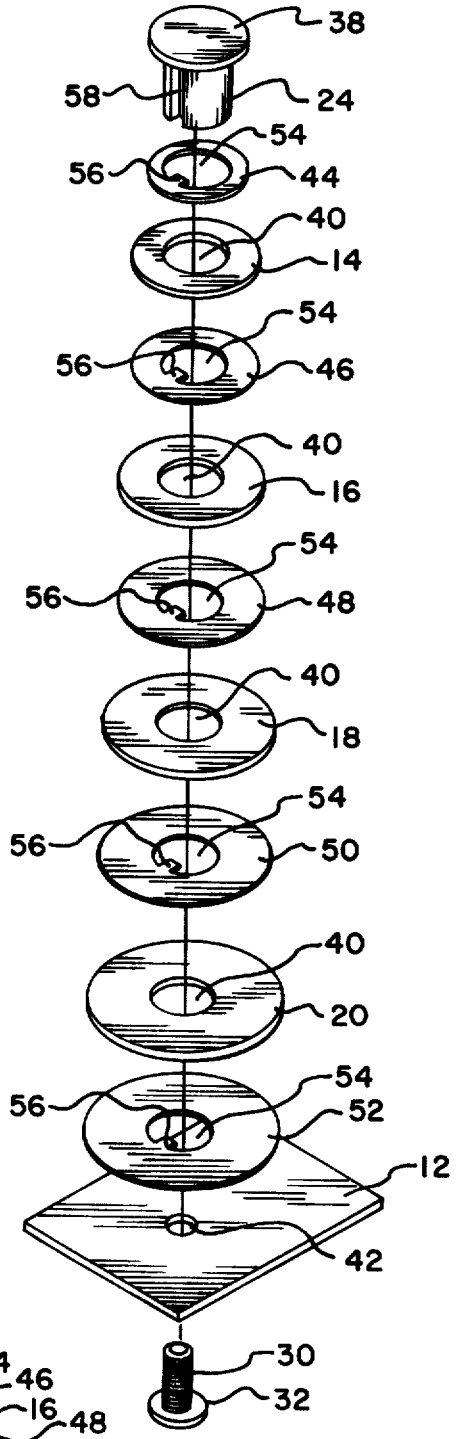

Referring now to FIG. 4 of the drawing there is shown an exploded perspective view of the complete rotary disc calculator shown in FIGS. 1–3 and showing in detail the new and novel improvement in the calculator wherein the adjacent rotary disc elements are prevented from turning whenever an adjacent element is rotated as will be more fully described now. The central hub 24 has formed on one end thereof a stop 38 in the form of a circular thin flat section which would be molded with the central hub 24 if the central hub were made out of plastic or some other moldable material.

Each rotary disc element 14–20 contains a hole 40 for receiving the central hub 24 and in a like manner the rectangular base 12 contains a hole 42 for receiving the bolt 30.

Positioned between each rotary disc element 14–20 and between the rotary disc element 20 and the rectangular base 12 are a plurality of separating spacer elements 44, 46, 48, 50 and 52 as may be desired by the manufacturer of the device with the separating spacer element being formed of a plastic material in the preferred embodiment. The spacer elements 44–52 each contain a hole 54 which is sized to receive the central hub 24 as it passes through the respective holes in the rotary disc elements and the spacer elements.

Each separating spacer 44–52 has also formed thereon means for retaining the rotation of the spacer element whenever superimposed discs are rotated with the retaining means comprising the hole 54 having at least one protuberance 56 formed therein which is designed and sized to fit within an engaging means formed on the central hub with the engaging means being formed as an elongated slot 58 or keyway of the size to contain the protuberance 56 formed within the hole 54 of each spacer element 44–52.

Figure 5:
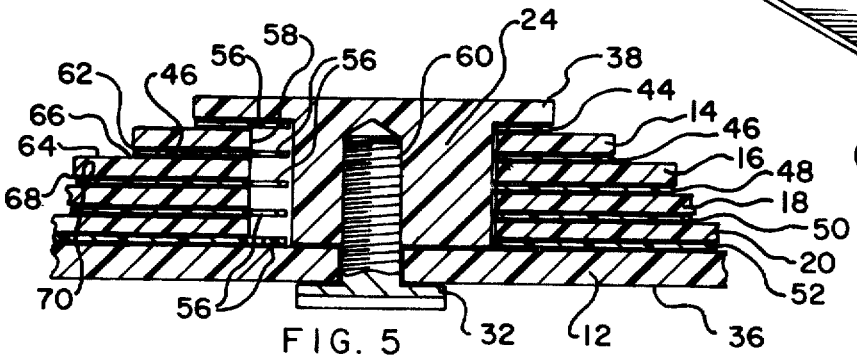

Referring now to FIG. 5 of the drawing there is shown an enlarged cross-sectional view, taken along line 5–5 of FIG. 3, showing the positioning of the various rotary disc elements and spacer elements on the central hub 24 and on top of the rectangular base 12. The central hub 24 has formed therein a female thread 60 for receiving the mating male thread formed on the bolt 30. It can be seen in FIG. 5 how the respective spacer elements 44–52 are positioned between selected rotary disc elements 14–20 and how the protuberance 56 of each spacer element are positioned within the elongated slot 58 whenever the new and novel calculator is assembled with the central hub 24 being positioned through the respective holes 54 in the spacer elements and the holes 40 in the rotary disc elements. When positioned in this manner it can be seen that, for example, whenever it is desired to rotate disc element 14 without disturbing the previous setting of disc element 16, the disc element 14 will make contact with the spacer element 46 and will rub against that element as shown at 62 while the spacer element 46 is restrained from rotation by means of its protuberance 56 being positioned within the elongated slot 58.

In a like manner should it be desired to rotate the disc element 16 without disturbing the setting on the disc element 14 or the disc element 18, it can be seen how a rotation of the disc element 16 causes the disc face 64 to rub against the spacer element 46 in the contact area 66 without disturbing the disc element 14 as a result of the protuberance 56 being positioned within the elongated slot 58. In a similar manner the disc face 68 of the disc element 16 will rub against the spacer element 48 along the contact area 70 with the protuberance 56 of the spacer element 48 restraining its rotary motion as a result of it being positioned within the elongated slot 58.

From this it can be seen that the respective positioning of the new and novel spacer elements 44–52 acts to restrain one rotary disc element from moving an adjacent rotary disc element as is highly desirous in calculator practice.

Figure 6:
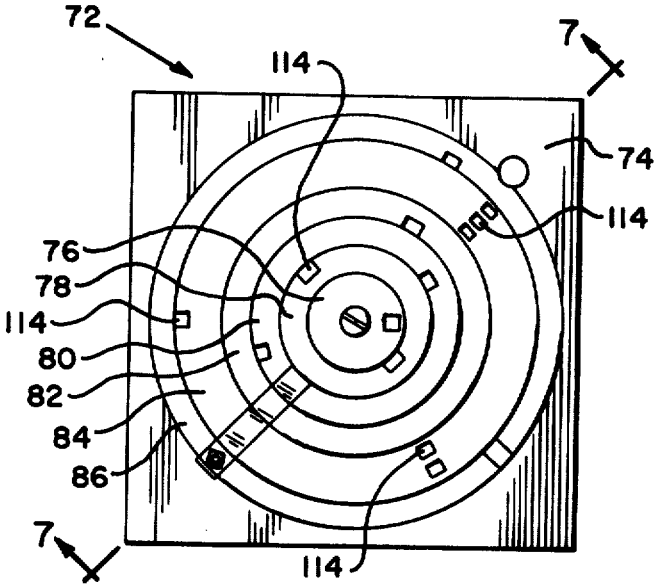
FIGS. 6-8 detail the preferred embodiment of the subject invention with the following figures illustrating the subject invention in various views.
Figure 7:
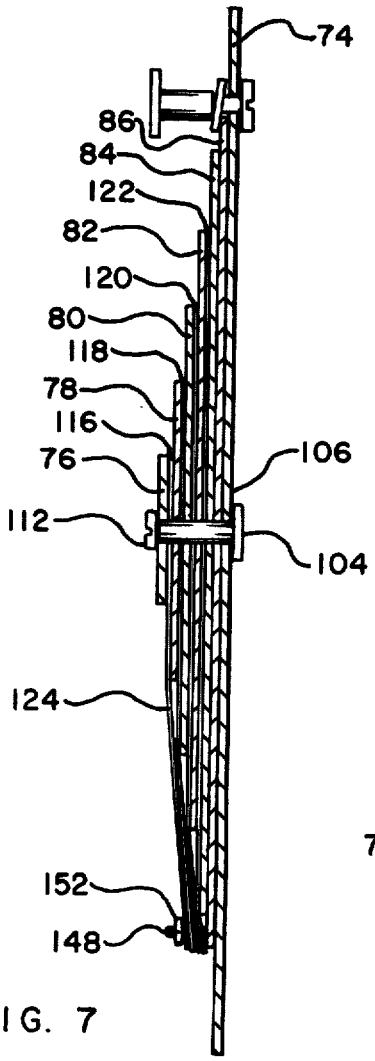
Figure 8:
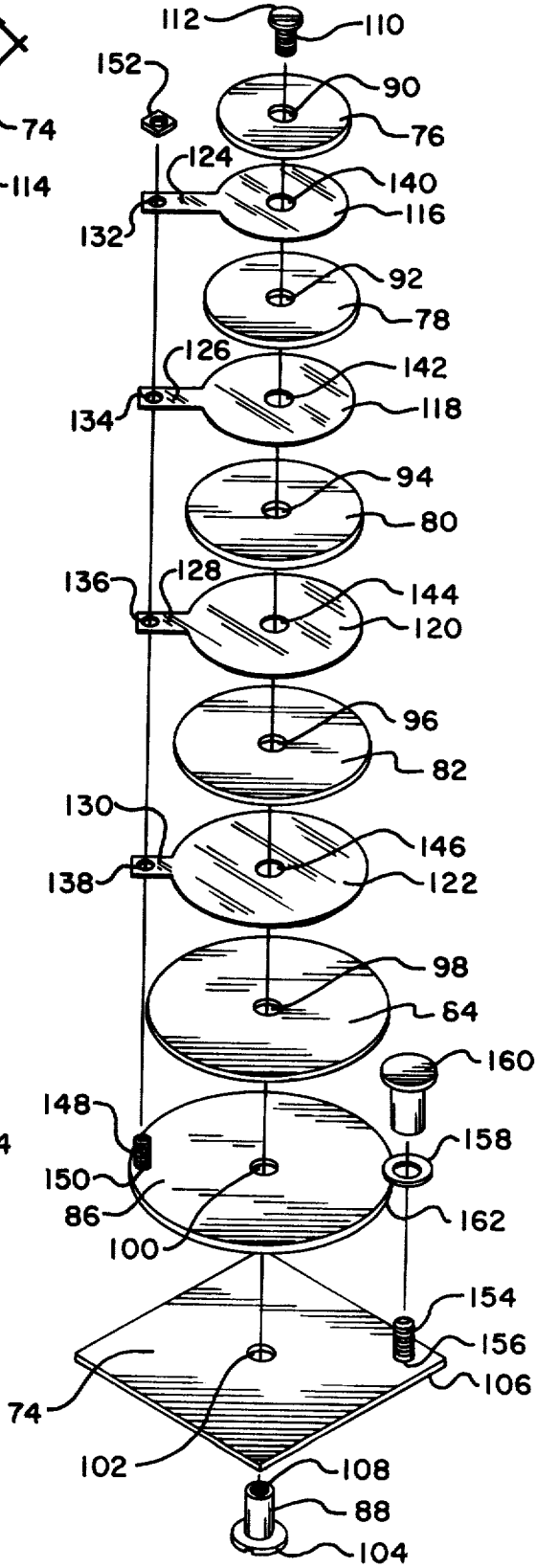

Referring now to the drawing FIGS. 6–8 in general and in particular to FIGS. 6 and 8, there is shown the improved preferred embodiment of the subject invention generally by the numeral 72 which comprises a rectangular shaped baseplate 74 having a plurality of rotatable reference discs 76, 78, 80, 82, 84 and 86. The discs 76–86 are rotatably mounted on the baseplate 74 by means of the central hub 88 which is inserted into the holes 90, 92, 94, 96, 98, 100 in the discs as well as the hole 102 in the baseplate 74.

The central hub 88 has a stop 104 formed on one end thereof for engagement with the back side 106 of the baseplate 74 and also has formed internally therein a female thread 108 for receiving a mating male screw thread 110 formed on the bolt 112. The central hub 88 and bolt 112 serve to contain the discs 76–86 on the baseplate 74.

A desired number of viewing windows 114 may also be formed on the discs as desired and the respective discs may be printed with indicia suitable for viewing through the windows.

By referring now to FIG. 8 there is shown a plastic separating spacer element 116, 118, 120 and 122 positioned between the respective reference discs, with each spacer element having formed thereon a protuberance 124, 126, 128 and 130 which extend outwardly from the edge of the spacer element and have formed thereon the holes 132, 134, 136 and 138. The central portion of the spacer elements have formed therein a hole 140, 142, 144 and 146 through which the central hub 88 passes.

The disc 86 has positioned thereon, on the outer edge thereof, a bolt 148 which is positioned through a hole 150. The bolt 148 also passes through the holes 138, 136, 134 and 132 and is held in place by the nut 152. When positioned in this manner it can be seen that the various discs can be rotated freely without moving the next adjacent disc because of the positioning of a superimposed separating element. For example, the disc 82 may be rotated without moving the upper disc 80 because of the placement of the separating spacer element 120 and the lower disc 84 is restrained from motion because of the separating element 122.

By referring now to FIG. 7 of the drawing it can be seen how the various protuberances 132, 134, 136 and 138 are positioned and locked in place on the bolt 148. It will also be seen how the disc 86 may also be restrained from rotation by means of the bolt 154 positioned through a hole 156 in the baseplate 74. The bolt 154 is positioned within a washer 158 and engages a nut 160 which contains a female thread as is well known in the fastening art. The washer 158 engages the edge 162 of the disc 86 and the nut 160 may be tightened on the bolt 154 to tightly affix the disc 86 to the baseplate 74.

When restrained thusly the respective spacer elements 116, 118, 120 and 122 are also restrained from motion whenever one of the superimposed discs are rotated on the adjacent spacer element. From the foregoing it can be seen how the reference discs may be rotated without interference with the setting of the next adjacent disc as a result of the placement of the new and novel separating spacer elements positioned between the reference discs which are restrained from rotation by the new and novel means shown in the drawing FIGS. 1–8. From the above it can be seen that there has been provided by the subject invention a new and improved rotary disc calculator in the various embodiments shown which may be utilized in many forms without departing from the spirit and scope of the invention. It should become apparent that the relative parts of the invention may be changed and modified within the spirit and scope of the invention which is not to be limited to the embodiments which have been given by way of illustration only.

Having described my invention, I claim:

1. A circular sliderule comprising:

(a) a central hub having formed thereon on one end thereof a stop;

(b) a plurality of reference discs rotatably positioned on said central hub;

(c) a separating spacer element positioned between selected reference discs, each said spacer element having formed thereon a protuberance, (1) said protuberance extending outwardly;

(d) means, associated with said protuberance, for preventing rotation of said spacer elements while permitting rotation of said reference discs, (1) said preventing means comprising said protuberances being fixedly attached together and fixedly attached to one of said reference discs; and (e) means, associated with said central hub, for containing said discs and said spacer elements on said central hub.

2. The sliderule as defined in claim 1 wherein said protuberances are fixedly attached together by a bolt and nut.

3. The sliderule as defined in claim 1 wherein said protuberances are fixedly attached to one of said reference discs by a bolt and nut.

4. The circular sliderule as defined in claim 1 further comprising said plurality of reference discs being positioned on a baseplate, said one of said reference discs being fixedly attached to said baseplate.

5. The circular sliderule as defined in claim 4 wherein said one of said reference discs is fixedly attached to said baseplate by a screw tightening clamp.

6. A circular sliderule comprising:

(a) a central hub having formed on one end thereof a stop;

(b) a baseplate positioned on said central hub;

(c) a plurality of reference discs rotatably positioned on said central hub with the first of said reference discs being positioned against said baseplate and each succeeding reference disc being positioned against the previous disc and being formed of a different size than the last disc;

(d) a separating spacer element positioned between selected reference discs and on the central hub, each said spacer element having formed thereon means for rotationally restraining the rotation of said spacer element, said restraining means comprising an outwardly extending protuberance being formed on each said spacer element and said protuberances being fixedly attached together, said protuberances being fixedly attached to one of said reference discs; and (e) means, associated with said hub, for holding said discs and spacer elements on said hub.

7. The sliderule as defined in claim 6 wherein said holding means comprises a bolt.

* * * * *